US009932201B2

(12) United States Patent
Reichert et al.

(10) Patent No.: US 9,932,201 B2
(45) Date of Patent: Apr. 3, 2018

(54) COIL TUBING SPOOL HANDLING DEVICE

(71) Applicant: Tenaris Coiled Tubes, LLC, Houston, TX (US)

(72) Inventors: Bruce Alan Reichert, Houston, TX (US); Thu-Ha Thi Nguyen, Houston, TX (US)

(73) Assignee: TENARIS COILED TUBES, LLC, Houston, TX (US)

( * ) Notice: Subject to any disclaimer, the term of this patent is extended or adjusted under 35 U.S.C. 154(b) by 591 days.

(21) Appl. No.: 14/496,394

(22) Filed: Sep. 25, 2014

(65) Prior Publication Data

US 2016/0090267 A1 Mar. 31, 2016

(51) Int. Cl.

| | |
|---|---|
| ***B65G 7/08*** | (2006.01) |
| ***B65H 75/02*** | (2006.01) |
| ***B65H 49/38*** | (2006.01) |

(52) U.S. Cl.

CPC ..... *B65H 75/02* (2013.01); *B65H 49/38* (2013.01); *B65H 2701/33* (2013.01)

(58) Field of Classification Search

CPC ..... B65H 75/02; B65H 49/38; B65H 2701/33
USPC ..... 414/399, 754, 756, 758, 768–770, 773, 414/777–779, 782, 919; 52/116
See application file for complete search history.

(56) References Cited

U.S. PATENT DOCUMENTS 2,439,581 A * 4/1948 Robins ..... B62B 1/264 248/143
2,910,304 A * 10/1959 Caylor ..... B62B 1/264 248/143
3,395,813 A * 8/1968 Bruce ..... B21C 47/24 414/719
3,620,395 A * 11/1971 Farmer, Sr. ..... H01F 41/00 254/94
5,184,743 A 2/1993 Suzuki et al.
5,480,277 A * 1/1996 Minz ..... B65G 65/23 414/21
5,634,610 A * 6/1997 Walsh ..... B65H 49/32 242/422.4
6,443,688 B1 * 9/2002 Komdeur ..... B65G 7/08 280/47.12
7,040,567 B1 * 5/2006 Lewis ..... B65D 5/4608 206/408
7,938,357 B2 * 5/2011 Johanson ..... B65H 49/322 242/422.4

(Continued)

*Primary Examiner* — Anna M Momper
*Assistant Examiner* — Lynn E Schwenning
(74) *Attorney, Agent, or Firm* — Fish & Richardson P.C.

(57) ABSTRACT

A coil tubing spool handling device includes a base structure and a vertical support structure. The base structure includes an upper surface, a lower surface, and a rocker portion with a curved surface to allow the base structure to rotate along the curved surface. The vertical support structure is connected to the base structure proximate the rocker portion, and extends substantially perpendicular to the upper surface. The vertical support structure and the upper surface can receive a coil tubing spool. A center of rotation of the rocker portion is located in a forward location relative to a center of gravity of the device when the vertical support structure and upper surface receive the coil tubing spool. The relative positions of the center of gravity and the center of rotation bias the handling device to rotate from a vertical position to a horizontal position.

20 Claims, 6 Drawing Sheets

(56) References Cited

U.S. PATENT DOCUMENTS

| | | | | |
|---|---|---|---|---|
| 8,177,472 | B2 * | 5/2012 | Charlier | B62D 65/02 414/778 |
| 2003/0071160 | A1 | 4/2003 | Cain et al. | |
| 2004/0028509 | A1 | 2/2004 | Aoki et al. | |
| 2006/0245890 | A1 * | 11/2006 | Hartman | B65D 19/0022 414/607 |
| 2006/0273213 | A1 | 12/2006 | Turk et al. | |
| 2011/0217124 | A1 * | 9/2011 | Taylor, Jr. | F16L 1/203 405/168.3 |
| 2014/0076533 | A1 | 3/2014 | Witte et al. | |

* cited by examiner

COIL TUBING SPOOL HANDLING DEVICE

TECHNICAL FIELD

This disclosure relates to a spooled coil tubing handling device and methods of handling and transport for spools of coil tubing.

BACKGROUND

Coil tubing often includes a continuous length of metal tubing wound on a spool. Spooled coil tubing is often used in oil and gas well operations, and can be produced in various lengths depending on specific application requirements. Similarly, a spool for a coil tubing string can take a variety of sizes and weights, varying in spool diameter, spool width, spool material, and/or other characteristics affecting the size and weight of the spool. Often, a spool includes a cylindrical core center with flanges on each end of the cylindrical core.

As the need increases for larger coil tubing (e.g., larger diameter and/or longer length), spool sizes and weights have increased to accommodate the larger coil tubing capacity. Thus, handling and transportation of coil tubing spools have become increasingly difficult.

SUMMARY

This disclosure describes a coil tubing spool handling device and methods of handling a coil tubing spool.

Certain aspects encompass a coil tubing spool handling device including a base structure and a vertical support structure. The base structure includes an upper surface, a lower surface adapted to support the device when the device is in a vertical position, and a rocker portion including a curved surface adapted to allow the base structure to rotate along the curved surface. The vertical support structure is connected to the base structure proximate the rocker portion, and extends substantially perpendicular to the upper surface. The vertical support structure and the upper surface are adapted to receive a coil tubing spool. A center of rotation of the rocker portion is located in a forward location relative to a center of gravity of the device when the device is in the vertical position and the vertical support structure and upper surface receive the coil tubing spool. The relative positions of the center of gravity and the center of rotation are adapted to bias the handling device to rotate along the curved surface from the vertical position to a horizontal position of the handling device.

The aspects above can include some, none, or all of the following features. The device is adapted to have a moment force directed at rotating the device on the curved surface of the rocker portion at any position along a 90 degree path of rotation from the vertical position to the horizontal position. The center of rotation of the rocker portion is located in a forward location relative to the center of gravity of the device with the coil tubing spool received thereon at any position of the device during rotation between the vertical position and the horizontal position. The base structure includes a first lateral member and a second lateral member, and the vertical support structure includes a first vertical support stand connected to the first lateral member of the base structure and a second vertical support stand connected to the second lateral member of the base structure. The upper surface of the base structure includes a first canted surface on the first lateral member of the base structure and a second canted surface on the second lateral member of the base structure, and each of the canted surfaces are tangential to circular flanges of the coil tubing spool at a point of contact between each canted surface and the circular flanges of the coil tubing spool. The device includes a first chock secured to the first vertical support stand and a second chock secured to the second vertical support stand, the first chock and second chock adapted to work in tandem to position the coil tubing spool on the device. The device includes a removable base stand to selectively position the device in the vertical position and restrain the device from rotating from the vertical position toward the horizontal position. The coil tubing spool includes a substantially cylindrical core connected to a pair of opposed circular flanges, a first of the opposed circular flanges positioned on a first end of the cylindrical core and a second of the opposed circular flanges positioned on a second end of the cylindrical core.

Certain aspects encompass a method of handling a coil tubing spool. The method includes positioning a coil tubing spool on a base structure of a coil tubing handling device with the handling device oriented in a vertical position, where a circular flange of the coil tubing spool contacts an upper surface of a base structure of the handling device and a circular flange of the coil tubing spool contacts a vertical support structure connected to the base structure, and where a lower surface of the base structure supports the coil tubing handling device when the handling device is oriented in the vertical position. The method further includes rotating the coil tubing handling device on a curved surface of the rocker portion of the base structure from the vertical position toward a horizontal position of the handling device, and maintaining a center of rotation of the rocker portion in a forward location relative to a center of gravity of the device with the coil tubing spool positioned thereon as the handling device is rotated from the vertical position toward the horizontal position. The relative positions of the center of gravity and the center of rotation bias the handling device to rotate along the curved surface of the rocker portion toward the horizontal position of the handling device.

The aspects above can include some, none, or all of the following features. The method includes directing a moment force on the curved surface of the rocker portion at any position along a 90 degree path of rotation from the vertical position to the horizontal position of the handling device. The method includes, after rotating the device to the horizontal position, lifting and transporting the device with the coil tubing spool positioned thereon, and positioning the device in a horizontal position on a bearing surface of a movable transport device. The method includes lifting the device from the bearing surface of the movable transport device and positioning the device in a horizontal position on a support surface. The method includes rotating the device from the horizontal position to a vertical position after positioning the device in the horizontal position on the support surface.

Certain aspects encompass a coil tubing spool handling assembly including a support surface and a coil tubing spool handling device supported by the support surface and rotatable between a vertical position and a horizontal position relative to the support surface. The coil tubing spool handling device includes a base structure including an upper surface, a lower surface in contact with the support surface when the coil tubing spool handling device is in the vertical position, and a rocker portion with a curved surface in contact with the support surface between the vertical position and the horizontal position of the coil tubing spool handling device, and a vertical support structure connected to the base structure proximate the rocker portion. The vertical support structure extends substantially perpendicular to the upper surface. The vertical support structure is oriented substantially perpendicular to the support surface when the handling device is in a vertical position, and is oriented substantially parallel to the support surface when the handling device is in a horizontal position. The vertical support structure and the upper surface are adapted to receive a coil tubing spool. A center of rotation of the rocker portion is located in a forward location relative to a center of gravity of the device when the handling device is in the vertical position and the vertical support structure and upper surface receive the coil tubing spool. The relative positions of the center of gravity and the center of rotation bias the handling device to rotate along the curved surface toward a horizontal position of the handling device.

The aspects above can include some, none, or all of the following features. The handling device includes a moment force biasing rotation of handling the device on the curved surface of the rocker portion at any position along a 90 degree path of rotation from the vertical position to the horizontal position of the handling device. The center of rotation of the rocker portion is located in a forward location relative to the center of gravity of the handling device with the coil tubing spool received thereon at any position of the handling device during a rotation of the handling device between the vertical position and the horizontal position. The base structure includes a first lateral member and a second lateral member, and the vertical support structure includes a first vertical support stand connected to the first lateral member of the base structure and a second vertical support stand connected to the second lateral member of the base structure. The upper surface of the base structure includes a first canted surface on the first lateral member of the base structure and a second canted surface on the second lateral member of the base structure, and each of the canted surfaces are tangential to circular flanges of the coil tubing spool at a point of contact between each canted surface and the circular flanges of the coil tubing spool. The assembly includes a first chock secured to the first vertical support stand and a second chock secured to the second vertical support stand, the first chock and second chock adapted to work in tandem to position the coil tubing spool on the device. The assembly includes a removable base chock to selectively position the handling device in the vertical position and restrain the handling device from rotating from the vertical position toward the horizontal position.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

This disclosure describes a coil tubing spool handling device, and methods of handling and transporting spools of coil tubing. A coil tubing spool handling device allows a transition of spools of coiled tubing from a vertical position to a horizontal position, and vice-versa. In some implementations, the coil tubing spool handling device includes attachment points and fixtures to allow for adequate securing of a spool to the handling device, adequate securing of the handling device to a transportation surface, and/or the spool to the transportation surface. In some implementations, with a coil tubing spool handling device in a horizontal position and supporting a coil tubing spool, the handling device expands a loading footprint to avoid point-loading, secures the spool to the handling device, allows for transportation and handling of the handling device with a conventional crane, and/or satisfies standard transportation requirements for trailers, ship decks, aircraft (e.g., Anotov An-124), barges, rail cars, and/or other movable transport devices.

Figure 1A:
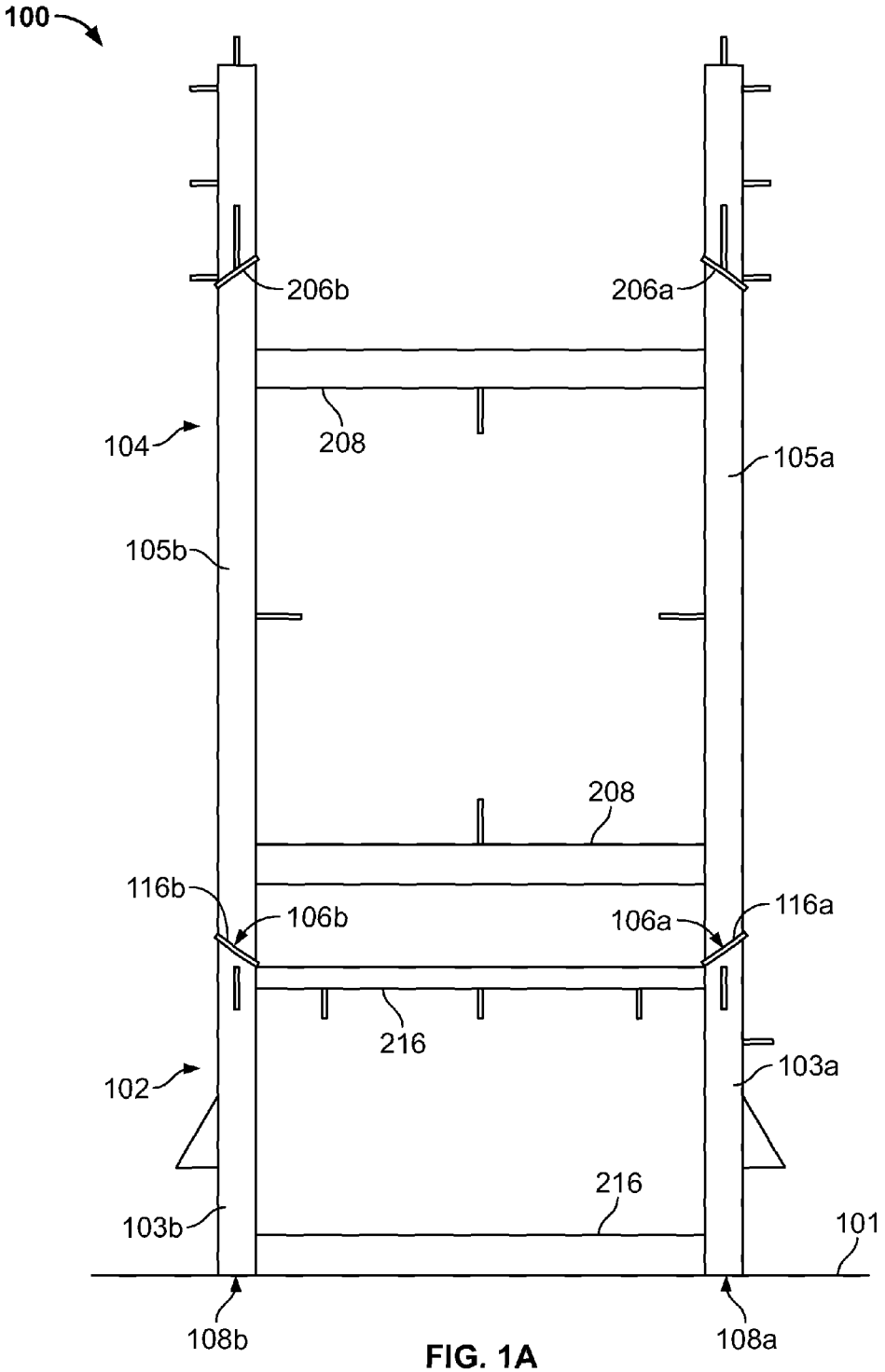
FIGS. 1A and 1B are schematic front and side views, respectively, of an example coil tubing spool handling device in a vertical position on a support surface.
Figure 1B:
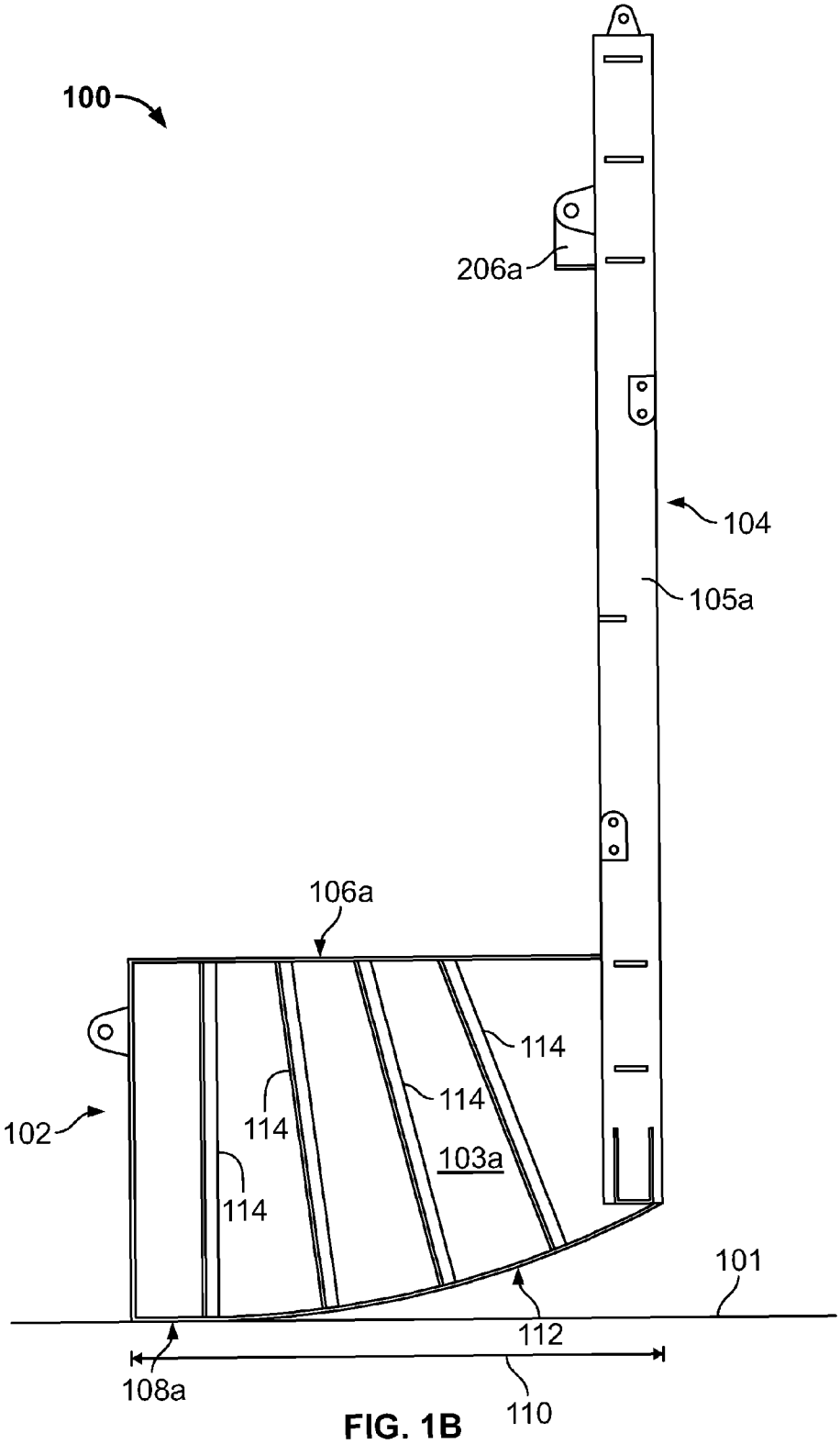

FIGS. 1A and 1B are schematic front and side views, respectively, of an example coil tubing spool handling device 100 in a vertical position on a support surface 101. The handling device 100 includes a base structure 102 having a first lateral member 103*a* and a second lateral member 103*b*, and a vertical support structure 104 having a first support stand 105*a* and a second support stand 105*b*. The first support stand 105*a* and the second support stand 105*b* are connected to the base structure 102 at the first lateral member 103*a* and the second lateral member 103*b*, respectively. The first and second lateral members 103*a* and 103*b* of the base structure 102 each include an upper surface 106*a* and 106*b*, a lower surface 108*a* and 108*b*, and a rocker portion 110, respectively. In the example device 100 shown in FIGS. 1A and 1B, the first lateral member 103*a* and second lateral member 103*b* substantially mirror each other, and the first support stand 105*a* and the second support stand 105*b* substantially mirror each other. The rocker portions 110 of the lateral members 103*a* and 103*b* each have a curved surface 112 to allow the base structure 102, and thus the handling device 100, to rotate along the curved surfaces 112, for example, against the support surface 101 (e.g., Earth surface, dock, deck surface of a ship or boat, cargo truck surface, oil rig platform deck, and/or other surface). The lower surfaces 108*a* and 108*b* support the handling device 100, for example, against the support surface 101 when the handling device 100 is in the vertical position, such as depicted in FIGS. 1A and 1B. The vertical support structure 104 extends substantially perpendicular to the upper surfaces 106*a* and 106*b* proximate the rocker portions 110 of the base structure 102. In some implementations, such as depicted in FIGS. 1A-1B, the base structure 102 includes structural columns 114 between the upper surface 106*a* and the lower surface 108*a*, and between the upper surface 106*a* and the curved surface 112 of the rocker portion 110, for example, for structural rigidity of the first lateral member 103*a* of the base structure 102, increased load-bearing capacity of the base structure 102, and/or other. Similarly, the base structure 102 can include structural columns 114 between the upper surface 106*b* and the lower surface 108*b*, and between the upper surface 106*b* and the curved surface 112 of the rocker portion 110 of the second lateral member 103*b*. In the example handling device 100, the structural columns 114 include L-beams connected on one end to the curved surface 112 and on the other end to the upper surface 106*a*, where the structural columns 114 are angled (substantially or exactly) perpendicular to the curved surface 112 and extending linearly to the upper surface 106*a*. However, the structural columns 114 can take many forms, including I-beams, square beams, cross-supports, and/or other reinforcement supports.

Figure 2A:
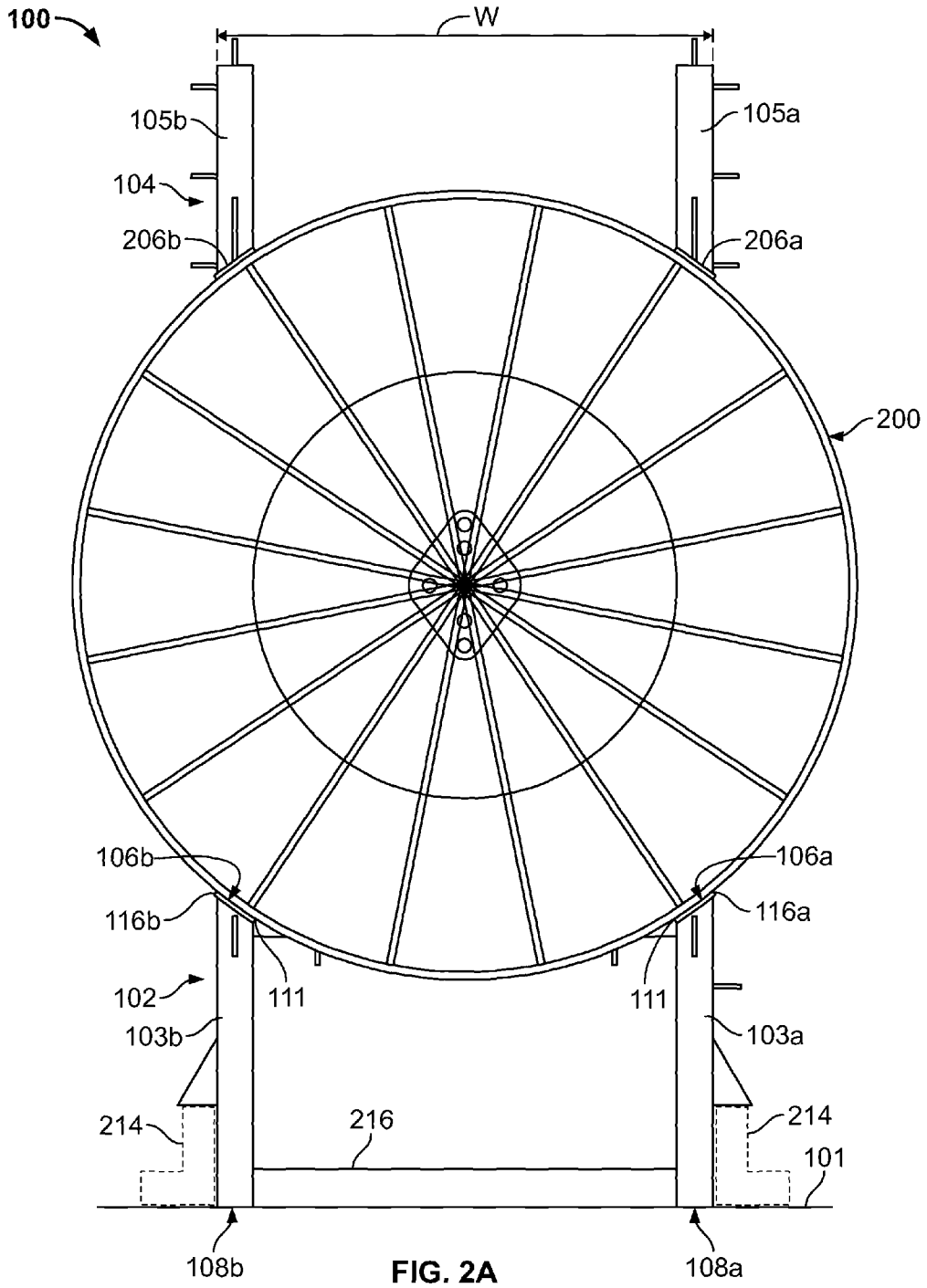
FIGS. 2A and 2B are schematic front and side views, respectively of an example coil tubing spool handling device in a vertical position and with a coil tubing spool.
Figure 2B:
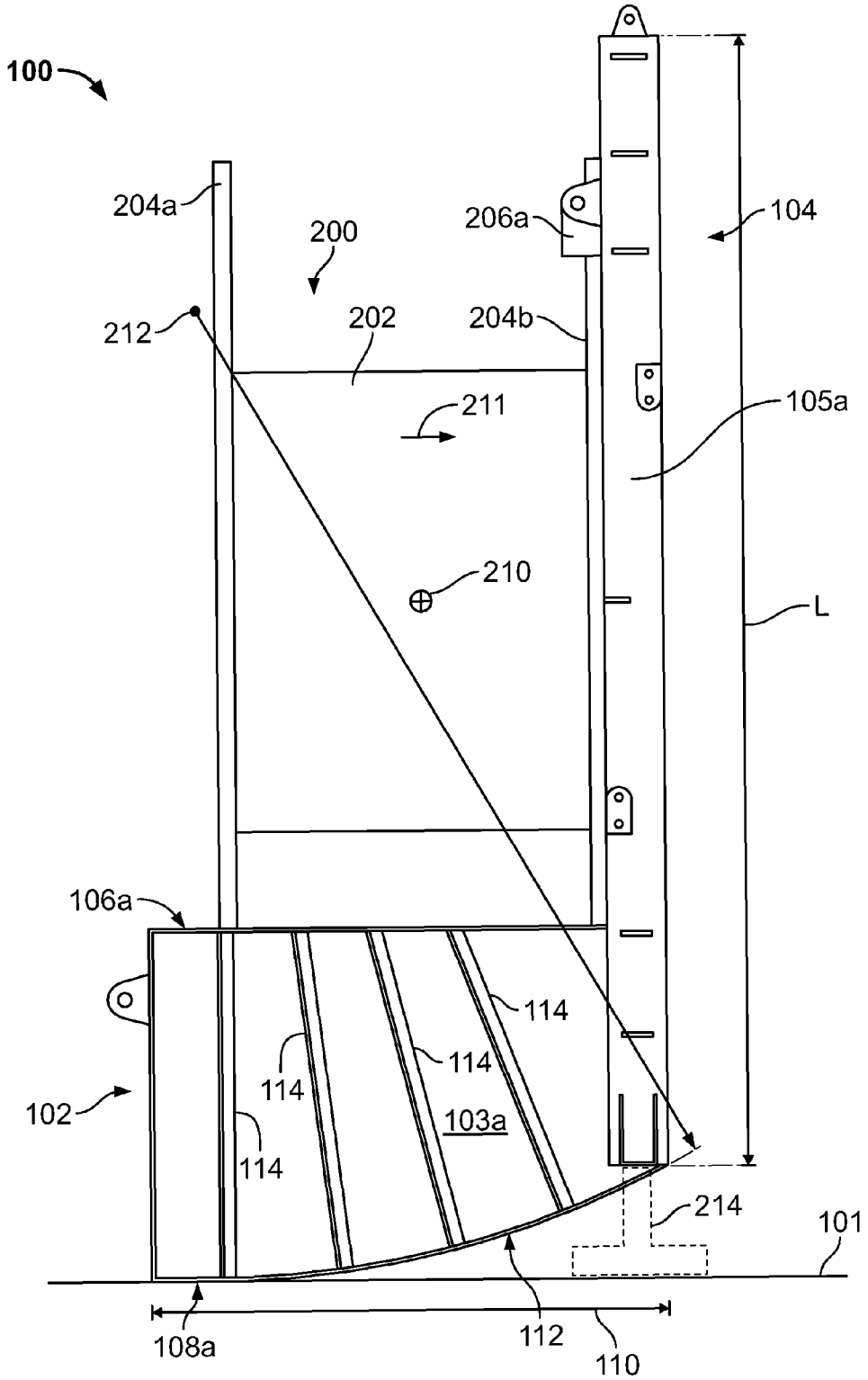

In some implementations, the vertical support structure 104 and upper surfaces 106*a* and 106*b* receive a coil tubing spool. For example, FIGS. 2A and 2B are schematic front and side views, respectively, of the example coil tubing spool handling device 100 in a vertical position and including a coil tubing spool 200 received on the example handling device 100. In some examples, a coil tubing spool 200 includes a substantially cylindrical core 202 connected to a pair of opposed circular flanges 204*a* and 204*b* positioned on opposing ends of the cylindrical core 202. The coil tubing spool 200 may have a variety of dimensions, due to size and weight restrictions for transportation, storage, or operational environments, and on a coil tubing type, length, or weight, and/or other factors. FIGS. 1A-2B show the upper surfaces 106*a* and 106*b* of the base structure 102 as including a first canted surface 116*a* on the first lateral member 103*a* and a second canted surface 116*b* on the second lateral member 103*b*, respectively. The first and second canted surfaces 116*a* and 116*b* are positioned such that they are tangential to the circular flanges 204*a* and 204*b* of the coil tubing spool 200 at the point of contact 111 between each canted surface 116*a* and 116*b* and the circular flanges 204*a* and 204*b*. However, the upper surfaces 106*a* and 106*b* can take many forms. For example, the upper surface 106*a* and 106*b* can include a single curved surface extending between the lateral ends of the base structure 102 (e.g., between first lateral member 103*a* and second lateral member 103*b*) and substantially matching a profile of the circular flanges of the coil tubing spool. In some examples, the base structure 102 include indents, protrusions, and/or other irregularities in the upper surfaces 106*a* and 106*b* to match a shape profile of the circular flanges 204*a* and 204*b* and/or the cylindrical core 202. In some examples, the upper surfaces 106*a* and 106*b* include spokes, securing eyes, chocks, spacers, and/or other components to position, place, and/or secure the coil tubing spool 200 to the handling device 100. FIGS. 1A-2B also show the vertical support structure 104 as including the two vertical support stands 105*a* and 105*b* connected to the respective lateral members 103*a* and 103*b* (i.e., at opposing lateral ends of the base structure 102). However, the vertical support structure 104 can take many forms. For example, the vertical support structure 104 can include two, three, or more vertical support stands or a single support stand with a width greater than, equal to, or less than a width of the base structure 102, and/or another configuration. In some examples, the vertical support structure 104 includes indents, protrusions, and/or other irregularities in the surface of the vertical support structure 104 to match a shape profile of the circular flange 204*b* that rests against the vertical support structure 104. In some examples, the vertical support structure 104 includes spokes, securing eyes, chocks, spacers, and/or other components to position, place, and/or secure the coil tubing spool 200 to the handling device 100 and/or allow for controlled movement of the handling device 100. For example, FIGS. 1A-2B show a first chock 206*a* attached to the first vertical support stand 105*a* and a second chock 206*b* attached to the second vertical support stand 105*b*. The first chock 206*a* and second chock 206*b* can work in tandem to position the coil tubing spool 200 on the handling device 100, for example, to reside on the vertical support structure 104 adjacent to a periphery of the circular flange 204*b*. In certain implementations, the first chock 206*a* and second chock 206*b* have surfaces tangential to the periphery of the circular flange 204*b*. In certain implementations, the chocks 206*a* and 206*b* are removable and/or adjustable based on a size of a coil tubing spool to be received on the handling device 100. The vertical support structure 104 can include one or more crossbars 208 (see FIGS. 1A, 3, and 4) between the first and second vertical support stands 105*a* and 105*b*, for example, for structural rigidity, additional support for the coil tubing spool 200, and/or other.

Figure 3:
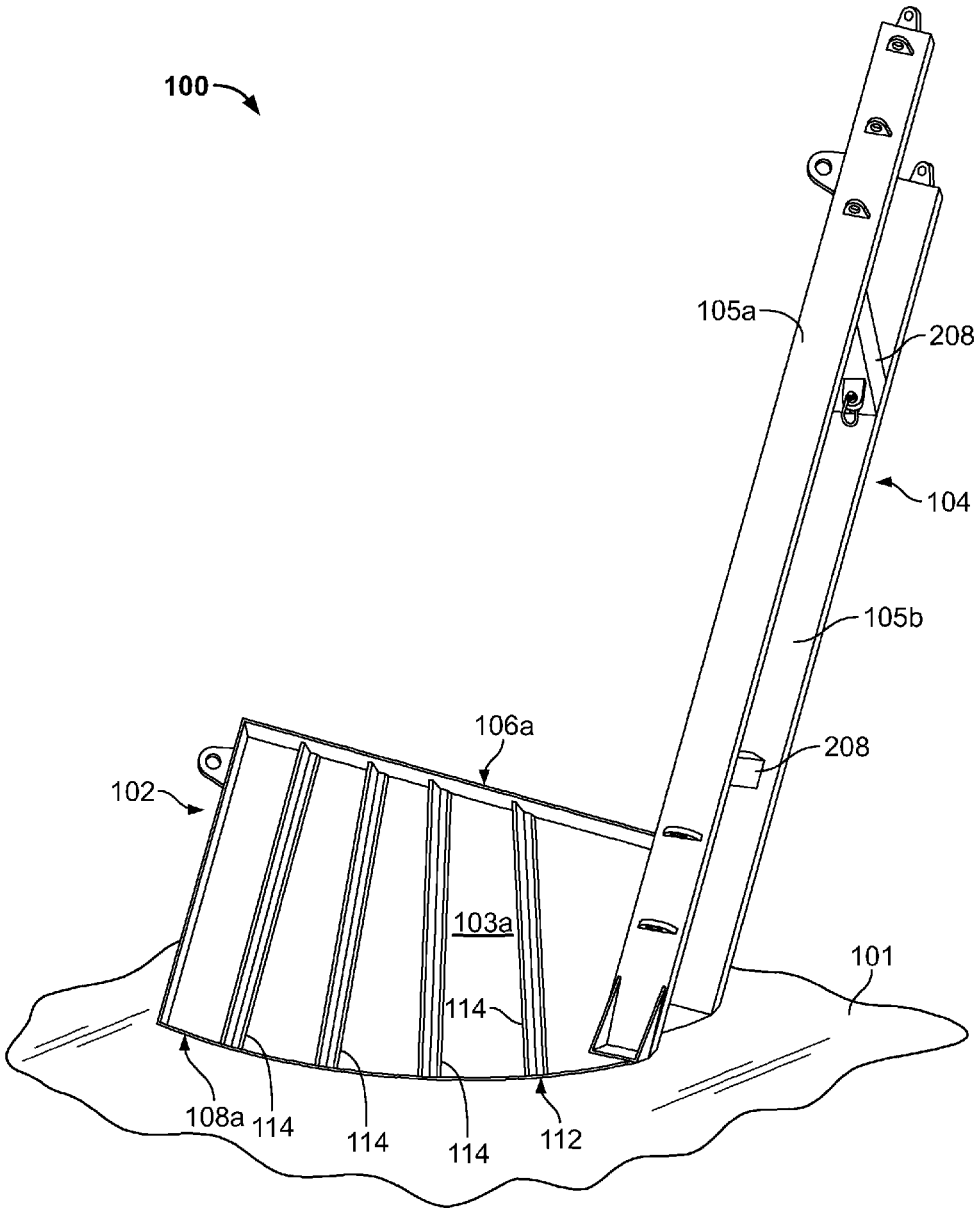
FIG. 3 is a perspective view from the side of an example coil tubing spool handling device in an intermediate position between a vertical position and a horizontal position on a support surface.
Figure 4:
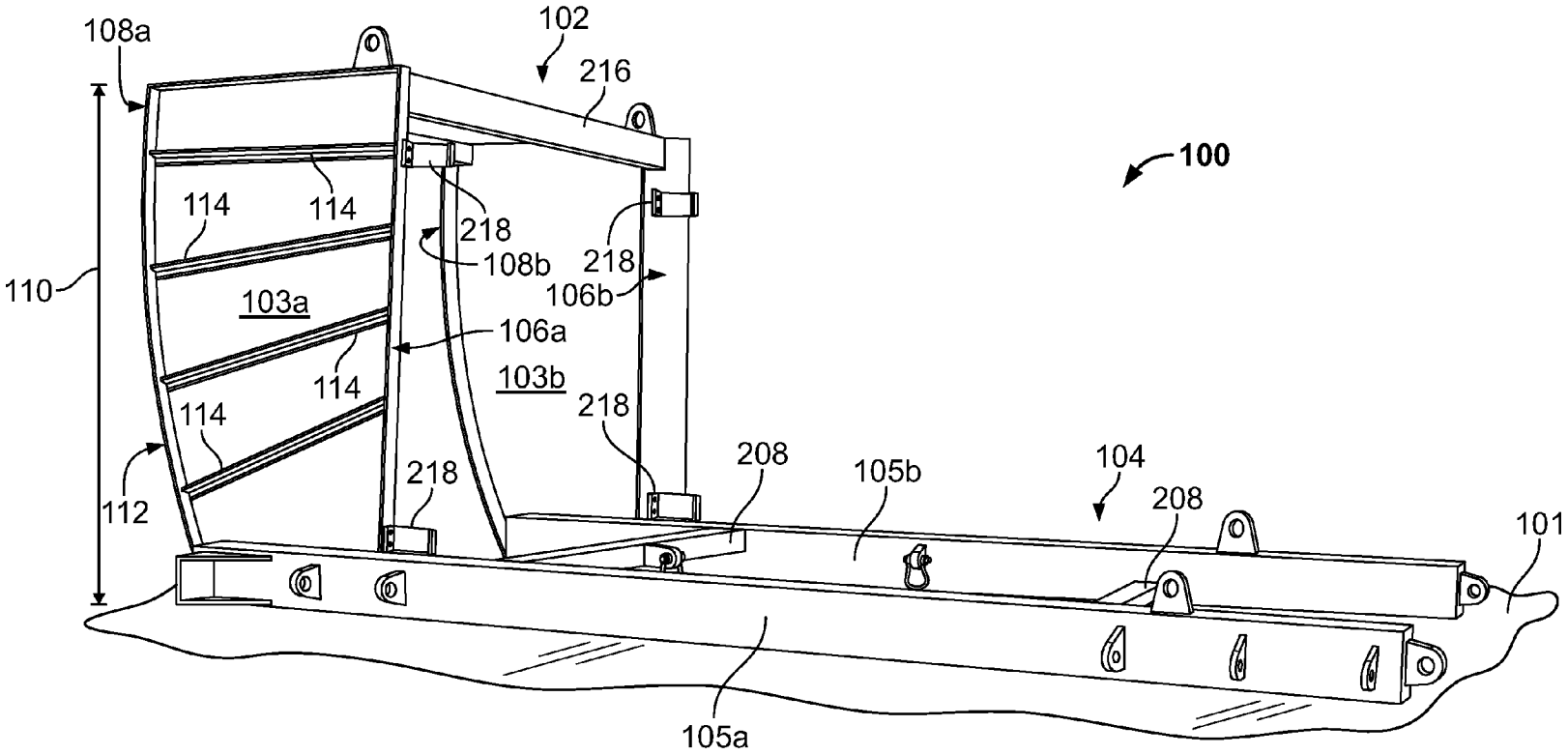
FIG. 4 is a perspective view from the side of an example coil tubing spool handling device in a horizontal position on a support surface.

With the handling device 100 in the vertical position and the coil tubing spool 200 received on the handling device 100 (see FIGS. 2A and 2B), a center of rotation 212 defined by the curved surfaces 112 of the rocker portions 110 of the base structure 102 is located in a forward location relative to a center of gravity 210 of the handling device 100 with the coil tubing spool 200 positioned on the device 100. The relative positions of the center of gravity 210 (i.e., instantaneous center of gravity of the handling device 100 carrying the coil tubing spool 200) and the center of rotation 212 (i.e., instantaneous center of rotation of the rocker portion 110) bias the handling device 100 to rotate along the curved surface 112 in a backward direction 211 toward a horizontal position of the handling device 100. FIGS. 3 and 4 are perspective views from the side of the example handling device 100 showing an intermediate position (e.g., between the vertical position and the horizontal position) and the horizontal position, respectively, of the handling device 100 on the support surface 101. With the handling device 100 in the vertical position and supporting the coil tubing spool 200, the handling device 100 is biased to rotate in the backward direction 211 toward the horizontal position, for example, without additional applied force from an external source (e.g., crane, forklift, and/or other). In other words, if left unsupported in the vertical position, the handling device 100 wants to rotate backward from the vertical position to the horizontal position. Throughout rotation of the handling device 100 between the vertical position and the horizontal position, with (or without) the coil tubing spool 200, the center of rotation 212 does not pass behind (e.g., horizontally pass behind) the center of gravity 210, for example, to avoid unstable conditions such as an external source requiring to catch a coil tubing spool when a center of gravity passes over a center of rotation. In other words, a moment force biases the handling device 100 to rotate on the curved surfaces 112 of the rocker portions 110, for example, with the handling device 100 at any position along a 90 degree path of rotation between the vertical position and the horizontal position of the handling device 100. In certain implementations, a rotation of the handling device 100 from the vertical position to the horizontal position can be considered a rotation in a backward direction (e.g., along the backward direction 211).

The vertical position of the handling device 100 depicted in FIGS. 1A-2B and the horizontal position of the handling device 100 depicted in FIG. 4 are exemplary positions, and can vary. For example, the vertical position can correlate to a substantially or exactly perpendicular orientation of the vertical support structure 104 relative to the support surface 101, such as an Earth surface, dock, deck surface of a ship or boat, cargo truck surface, oil rig platform deck, and/or other surface. In some examples, the horizontal position can correlate to a substantially or exactly parallel orientation of the vertical support structure 104 relative to the support surface 101. The support surface 101 can be flat, horizontal, curved, angled, and/or other. In some implementations, the vertical position of the handling device 100 correlates to the handling device 100 being supported directly by the lower surfaces 108*a* and 108*b* against a support surface 101 and/or indirectly, for example, via shims or other intermediate support element. In some implementations, the horizontal position of the handling device 100 correlates to the handling device 100 being supported by the vertical support structure 104 against the support surface 101 directly and/or indirectly.

In some implementations, such as depicted in FIGS. 2A-2B, one or more removable base stands 214 selectively position the handling device 100 in the vertical position and restrain the handling device 100 from rotating from the vertical position toward the horizontal position. In some examples, the removable base stand applies a force against the handling device 100 proximate the rocker portion 110 of the base structure 102 to overcome the bias of the handling device 100 to rotate toward the horizontal position.

Although FIGS. 1A-4 show the base structure 102 as including two mirrored and substantially separate components (i.e., first and second lateral members 103*a* and 103*b*) connected laterally by one or more crossbars 216, the base structure 102 can include additional or different features and components. For example, the base structure 102 can include a single unit across the width (e.g., W of FIG. 2A) of the handling device 100, or two or more substantially separate components connected laterally by crossbars. In some implementations, such as depicted in FIG. 4, the base structure 102 includes base chocks 218 on the upper surfaces 106*a* and 106*b* of the base structure 102, for example, to position and/or secure the flanges 204*a* and 204*b* of the coil tubing spool 200 on the upper surfaces 106*a* and 106*b*. FIG. 4 shows four base chocks 218 on the upper surfaces 106*a* and 106*b*; however, the base structure 102 can include a different number of base chocks 218 (e.g., 1, 2, or 3 or more base chocks). In certain implementations, the base chocks 218 are removable and/or adjustable based on a size of the coil tubing spool to be received on the handling device 100.

In certain implementations, the handling device 100 include securing attachments, such as spoke-mounted securing eyes, on the vertical support structure 104 and/or base structure 102, for example, to allow securing of the device to a surface of a movable transport device (e.g., a cargo ship, truck bed, aircraft loading ramp, aircraft cargo bay, barge platform, rail car platform, and/or other), and/or to allow secure rotation of the handling device 100 between the vertical and horizontal positions. In certain implementations, with the handling device 100 in the horizontal position, a length (e.g., L of FIG. 2B) and/or width (e.g., W of FIG. 2A) of the vertical support structure 104 (e.g., a footprint of the vertical support structure 104) satisfies cargo load distribution requirements for aircraft (e.g., Anotov An-124, or other), cargo ships, and/or cargo trucks. For example, a length, L, and a width, W, of a handling device can be 280 inches and 133.75 inches, respectively, to properly distribute the weight of a coil tubing spool of 213 inches or smaller in diameter in order to transport the coil tubing spool via cargo aircraft.

A number of implementations have been described. Nevertheless, it will be understood that various modifications may be made without departing from the spirit and scope of the disclosure.

What is claimed is:

1. A coil tubing spool handling device comprising:

a base structure comprising:

an upper surface;

a lower surface adapted to support the device when the device is in a vertical position; and a rocker portion comprising a curved surface adapted to allow the base structure to rotate along the curved surface; and a vertical support structure connected to the base structure proximate the rocker portion, the vertical support structure extending substantially perpendicular to the upper surface;

the vertical support structure and the upper surface being adapted to receive a coil tubing spool;

wherein a center of rotation of the rocker portion is located in a forward location relative to a center of gravity of the device when the device is in the vertical position and the vertical support structure and upper surface receive the coil tubing spool, and, with the device in the vertical position, the vertical support structure is at a rearward location opposite the forward location relative to the center of gravity; and wherein the relative positions of the center of gravity and the center of rotation are adapted to bias the handling device to rotate along the curved surface from the vertical position to a horizontal position of the handling device.

2. The device of claim 1 being adapted to have a moment force directed at rotating the device on the curved surface of the rocker portion at any position along a 90 degree path of rotation from the vertical position to the horizontal position.

3. The device of claim 2, wherein the center of rotation of the rocker portion is located in a forward location relative to the center of gravity of the device with the coil tubing spool received thereon at any position of the device during rotation between the vertical position and the horizontal position.

4. The device of claim 1, wherein the base structure comprises a first lateral member and a second lateral member, and wherein the vertical support structure comprises a first vertical support stand connected to the first lateral member of the base structure and a second vertical support stand connected to the second lateral member of the base structure.

5. The device of claim 4, wherein the upper surface of the base structure comprises a first canted surface on the first lateral member of the base structure and a second canted surface on the second lateral member of the base structure, and wherein each of the canted surfaces are tangential to circular flanges of the coil tubing spool at a point of contact between each canted surface and the circular flanges of the coil tubing spool.

6. The device of claim 4, comprising a first chock secured to the first vertical support stand and a second chock secured to the second vertical support stand, the first chock and second chock being adapted to work in tandem to position the coil tubing spool on the device.

7. The device of claim 1, comprising a removable base stand to selectively position the device in the vertical position and restrain the device from rotating from the vertical position toward the horizontal position.

8. The device of claim 1, wherein the coil tubing spool comprises a substantially cylindrical core connected to a pair of opposed circular flanges, a first of the opposed circular flanges positioned on a first end of the cylindrical core and a second of the opposed circular flanges positioned on a second end of the cylindrical core.

9. A method of handling a coil tubing spool, the method comprising:

positioning a coil tubing spool on a base structure of a coil tubing handling device with the handling device oriented in a vertical position, wherein a circular flange of the coil tubing spool contacts an upper surface of a base structure of the handling device, and a circular flange of the coil tubing spool contacts a vertical support structure connected to the base structure at a rearward location on the coil tubing handling device when the coil tubing handling device is oriented in the vertical position, and wherein a lower surface of the base structure supports the coil tubing handling device when the handling device is oriented in the vertical position;

rotating, in a rearward direction, the coil tubing handling device on a curved surface of a rocker portion of the base structure from the vertical position toward a horizontal position of the handling device; and maintaining a center of rotation of the rocker portion in a forward location relative to a center of gravity of the device with the coil tubing spool positioned thereon as the handling device is rotated from the vertical position toward the horizontal position; and wherein the relative positions of the center of gravity and the center of rotation bias the handling device to rotate along the curved surface of the rocker portion toward the horizontal position of the handling device.

10. The method of claim 9, further comprising directing a moment force on the curved surface of the rocker portion at any position along a 90 degree path of rotation from the vertical position to the horizontal position of the handling device.

11. The method of claim 9, further comprising:

after rotating the device to the horizontal position, lifting and transporting the device with the coil tubing spool positioned thereon; and positioning the device in a horizontal position on a bearing surface of a movable transport device.

12. The method of claim 11, further comprising:

lifting the device from the bearing surface of the movable transport device and positioning the device in a horizontal position on a support surface.

13. The method of claim 12, further comprising rotating the device from the horizontal position to a vertical position after positioning the device in the horizontal position on the support surface.

14. A coil tubing spool handling assembly comprising:

a support surface; and a coil tubing spool handling device supported by the support surface and rotatable between a vertical position and a horizontal position relative to the support surface, the coil tubing spool handling device comprising:

a base structure including an upper surface, a lower surface in contact with the support surface when the coil tubing spool handling device is in the vertical position, and a rocker portion with a curved surface in contact with the support surface between the vertical position and the horizontal position of the coil tubing spool handling device; and a vertical support structure connected to the base structure proximate the rocker portion, the vertical support structure extending substantially perpendicular to the upper surface, the vertical support structure oriented substantially perpendicular to the support surface when the handling device is in a vertical position, and the vertical support structure oriented substantially parallel to the support surface when the handling device is in a horizontal position; and wherein the vertical support structure and the upper surface are adapted to receive a coil tubing spool;

wherein a center of rotation of the rocker portion is located in a forward location relative to a center of gravity of the device when the handling device is in the vertical position and the vertical support structure and upper surface receive the coil tubing spool, and, with the device in the vertical position, the vertical support structure is at a rearward location opposite the forward location relative to the center of gravity; and wherein the relative positions of the center of gravity and the center of rotation bias the handling device to rotate along the curved surface toward a horizontal position of the handling device.

15. The assembly of claim 14, wherein the handling device comprises a moment force biasing rotation of handling the device on the curved surface of the rocker portion at any position along a 90 degree path of rotation from the vertical position to the horizontal position of the handling device.

16. The assembly of claim 15, wherein the center of rotation of the rocker portion is located in a forward location relative to the center of gravity of the handling device with the coil tubing spool received thereon at any position of the handling device during a rotation of the handling device between the vertical position and the horizontal position.

17. The assembly of claim 14, wherein the base structure comprises a first lateral member and a second lateral member, and wherein the vertical support structure comprises a first vertical support stand connected to the first lateral member of the base structure and a second vertical support stand connected to the second lateral member of the base structure.

18. The assembly of claim 17, wherein the upper surface of the base structure comprises a first canted surface on the first lateral member of the base structure and a second canted surface on the second lateral member of the base structure, and wherein each of the canted surfaces are tangential to circular flanges of the coil tubing spool at a point of contact between each canted surface and the circular flanges of the coil tubing spool.

19. The assembly of claim 18, further comprising a first chock secured to the first vertical support stand and a second chock secured to the second vertical support stand, the first chock and second chock being adapted to work in tandem to position the coil tubing spool on the device.

20. The assembly of claim 14, further comprising a removable base chock to selectively position the handling device in the vertical position and restrain the handling device from rotating from the vertical position toward the horizontal position.

* * * * *